US011350730B2

(12) United States Patent
Olson

(10) Patent No.: US 11,350,730 B2
(45) **Date of Patent: *Jun. 7, 2022**

(54) ORAL CARE DEVICE

(71) Applicant: Olson IP Technologies, Inc., Mundelein, IL (US)

(72) Inventor: Richard Carl Olson, Deerfield Beach, FL (US)

(73) Assignee: Olson IP Technologies, Inc., Mundelein, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/103,126

(22) Filed: Nov. 24, 2020

(65) Prior Publication Data

US 2021/0212450 A1 Jul. 15, 2021

Related U.S. Application Data

(63) Continuation of application No. 16/291,172, filed on Mar. 4, 2019, now Pat. No. 10,849,419.

(Continued)

(51) Int. Cl.

*A46B 9/02* (2006.01)
*A46B 9/00* (2006.01)

(Continued)

(52) U.S. Cl.

CPC ..... *A46B 11/0079* (2013.01); *A46B 1/00* (2013.01); *A46B 5/026* (2013.01); *A46B 9/028* (2013.01);

(Continued)

(58) Field of Classification Search

CPC ..... A46B 1/0079; A46B 1/00; A46B 5/026; A46B 9/028; A46B 9/04; A46B 11/003; A46B 11/0089; A46B 17/04; A46B 9/00; A46B 9/026; A46B 9/045; A46B 11/0024; A46B 2200/1066; A46B 11/0041; A46B 5/02; A46B 11/079; A46B 11/00; A46B 11/0001; A46B 11/002

(Continued)

(56) References Cited

U.S. PATENT DOCUMENTS 1,327,757 A * 1/1920 Eggers ..... A46B 11/063 401/28
2,241,584 A 5/1941 Cohen (Continued)

FOREIGN PATENT DOCUMENTS

CN 2081671 7/1991
GB 2375040 6/2002

(Continued)

OTHER PUBLICATIONS

U.S. Appl. No. 60/408,321, filed Sep. 5, 2002, Hohlbein.

(Continued)

*Primary Examiner* — David J Walczak
(74) *Attorney, Agent, or Firm* — Fitch, Even, Tabin & Flannery LLP

(57) ABSTRACT

An oral care device includes a body and a base connected to the body. The oral care device includes a mouthpiece extending from the base and an oral care product reservoir in communication with the mouthpiece. A plurality of brushing walls extend from the base about the mouthpiece.

26 Claims, 8 Drawing Sheets

Related U.S. Application Data

(60) Provisional application No. 62/640,359, filed on Mar. 8, 2018.

(51) Int. Cl.

| | |
|---|---|
| ***A46B 9/04*** | (2006.01) |
| ***A46B 1/00*** | (2006.01) |
| ***A46B 5/02*** | (2006.01) |
| ***A46B 17/04*** | (2006.01) |
| ***A46B 11/00*** | (2006.01) |

(52) U.S. Cl.
CPC ..... *A46B 9/04* (2013.01); *A46B 11/0003* (2013.01); *A46B 11/0089* (2013.01); *A46B 17/04* (2013.01); *A46B 9/00* (2013.01); *A46B 9/026* (2013.01); *A46B 9/045* (2013.01); *A46B 11/0024* (2013.01); *A46B 2200/1066* (2013.01)

(58) Field of Classification Search
USPC ..... 401/268, 270, 282, 286; 15/187, 188, 15/207.2; D4/104–112, 132, 136
See application file for complete search history.

(56) References Cited

U.S. PATENT DOCUMENTS

| | | | | |
|---|---|---|---|---|
| 2,813,290 | A | 11/1957 | Aschenbach | |
| 3,356,095 | A | 12/1967 | Tylle | |
| 3,501,243 | A | 3/1970 | Heiskell | |
| 4,039,261 | A | 8/1977 | Evans | |
| 4,176,980 | A | 12/1979 | Oneal | |
| 4,429,434 | A | 2/1984 | Sung-Shan | |
| 4,503,871 | A | 3/1985 | Mendenhall | |
| 4,521,128 | A | 6/1985 | Oneal | |
| 4,530,129 | A | 7/1985 | Labick | |
| 4,588,089 | A | 5/1986 | Yanzjr | |
| 4,693,622 | A | 9/1987 | Booth | |
| D292,447 | S | 10/1987 | Macias | |
| 4,844,641 | A | 7/1989 | Grosfilley | |
| 4,850,730 | A | 7/1989 | Jimenez | |
| 4,865,481 | A | 9/1989 | Scales | |
| 4,911,187 | A | 3/1990 | Castillo | |
| 5,066,155 | A | 11/1991 | English | |
| 5,074,414 | A | 12/1991 | Romana | |
| 5,123,765 | A | 6/1992 | Oconnell | |
| 5,144,712 | A | 9/1992 | Hansel | |
| 5,184,719 | A | 2/1993 | Gordon | |
| 5,338,124 | A | 8/1994 | Spicer | |
| 5,348,153 | A | 9/1994 | Cole | |
| 5,425,591 | A | 6/1995 | Contreras | |
| D361,666 | S | 8/1995 | Keane | |
| 5,440,774 | A | 8/1995 | Cole | |
| 5,445,825 | A | 8/1995 | Copelan | |
| D368,374 | S | 4/1996 | Ashcraft | |
| 5,599,126 | A | 2/1997 | Hough | |
| 5,633,083 | A | 5/1997 | Iwai | |
| 5,769,553 | A | 6/1998 | Chaudhri | |
| 5,842,248 | A | 12/1998 | Vangrol | |
| 5,851,551 | A | 12/1998 | Tseng | |
| D403,510 | S * | 1/1999 | Menke | D4/104 |
| 5,893,378 | A | 4/1999 | Llerena | |
| 5,898,967 | A | 5/1999 | Wu | |
| 5,909,739 | A | 6/1999 | Masrour-Rad | |
| 5,915,868 | A | 6/1999 | Frazell | |
| 5,924,567 | A | 7/1999 | Wenum | |
| 6,018,840 | A | 2/2000 | Guay | |
| 6,056,466 | A | 5/2000 | Johnson | |
| 6,062,233 | A | 5/2000 | Williams | |
| D426,708 | S | 6/2000 | Francis | |
| 6,090,488 | A | 7/2000 | Kweon | |
| 6,095,157 | A | 8/2000 | Brown | |
| 6,179,503 | B1 | 1/2001 | Taghavi-Khanghah | |
| 6,244,777 | B1 | 6/2001 | Reid | |
| D448,569 | S * | 10/2001 | Harris | D4/104 |
| 6,315,556 | B1 | 11/2001 | Stewart | |
| 6,331,088 | B2 | 12/2001 | Owens | |
| 6,386,779 | B1 | 5/2002 | Davis | |
| 6,386,783 | B1 | 5/2002 | Spoelman | |
| 6,524,023 | B2 | 2/2003 | Andersen | |
| 6,648,641 | B1 | 11/2003 | Viltro | |
| 6,766,549 | B2 | 7/2004 | Klupt | |
| 6,964,357 | B2 | 11/2005 | Manganini | |
| D528,803 | S | 9/2006 | Hohlbein | |
| 7,112,003 | B2 | 9/2006 | Frison | |
| D532,202 | S | 11/2006 | Hohlbein | |
| D532,607 | S | 11/2006 | Hohlbein | |
| 7,182,542 | B2 | 2/2007 | Hohlbein | |
| 7,234,192 | B2 | 6/2007 | Barbar | |
| 7,237,560 | B2 | 7/2007 | Macias | |
| 7,244,073 | B2 | 7/2007 | Trocino | |
| 7,246,400 | B2 | 7/2007 | Ryan | |
| 7,293,318 | B1 | 11/2007 | Kuo | |
| 7,311,456 | B1 | 12/2007 | Neal | |
| 7,329,327 | B2 | 2/2008 | Mays | |
| 7,331,731 | B2 | 2/2008 | Hohlbein | |
| 7,350,526 | B2 | 4/2008 | Mccabe | |
| 7,399,133 | B1 | 7/2008 | Eversole | |
| 7,478,959 | B2 | 1/2009 | Hohlbein | |
| 7,722,274 | B2 | 5/2010 | Hohlbein | |
| 7,901,153 | B1 | 3/2011 | Strider | |
| 8,202,230 | B2 | 6/2012 | Gatzemeyer | |
| 8,419,306 | B1 | 4/2013 | Levine | |
| 8,529,150 | B2 | 9/2013 | Olson | |
| 8,595,886 | B2 * | 12/2013 | Edelstein | A46B 5/026 15/167.1 |
| 8,668,397 | B2 | 3/2014 | Barkhordar | |
| 9,232,853 | B2 | 1/2016 | Olson | |
| 9,603,442 | B2 | 3/2017 | Jimenez | |
| 9,781,995 | B2 | 10/2017 | Olson | |
| 10,390,607 | B2 | 8/2019 | Davies-Smith | |
| 10,477,954 | B2 | 11/2019 | Olson | |
| 10,799,329 | B2 | 10/2020 | Scheuren | |
| 10,849,419 | B2 | 12/2020 | Olson | |
| 2002/0044817 | A1 | 4/2002 | Hall | |
| 2002/0175101 | A1 | 11/2002 | Albert | |
| 2003/0077107 | A1 | 4/2003 | Kuo | |
| 2003/0086745 | A1 | 5/2003 | Micaletti | |
| 2004/0016073 | A1 | 1/2004 | Knutson | |
| 2004/0022576 | A1 | 2/2004 | Hoyle | |
| 2007/0086831 | A1 | 4/2007 | Wold | |
| 2008/0014010 | A1 | 1/2008 | Bartschi | |
| 2008/0028558 | A1 * | 2/2008 | Kwon | A46D 1/0276 15/167.1 |
| 2008/0118300 | A1 | 5/2008 | Burrowes | |
| 2008/0120798 | A1 | 5/2008 | Sorrentino | |
| 2008/0176183 | A1 | 7/2008 | Gatzemeyer | |
| 2009/0178219 | A1 | 7/2009 | Hohlbein | |
| 2009/0197220 | A1 | 8/2009 | Cindrich | |
| 2009/0255077 | A1 * | 10/2009 | Mori | A46D 1/023 15/167.1 |
| 2011/0067193 | A1 | 3/2011 | Olson | |
| 2014/0000051 | A1 | 1/2014 | Olson | |
| 2016/0113384 | A1 | 4/2016 | Olson | |
| 2020/0146432 | A1 | 5/2020 | Olson | |

FOREIGN PATENT DOCUMENTS

| | | |
|---|---|---|
| GB | 2375290 | 11/2002 |
| WO | 1997013428 | 4/1997 |
| WO | 2004021914 | 3/2004 |

OTHER PUBLICATIONS

U.S. Appl. No. 62/640,359, filed Mar. 8, 2018, Olson.
Hohlbein, Douglas J., U.S. Appl. No. 60/408,321, titled "Disposable Toothbrush," filed Sep. 5, 2002, 15 pages.

* cited by examiner

ORAL CARE DEVICE

CROSS-REFERENCE TO RELATED APPLICATIONS

This application is a continuation of U.S. patent application Ser. No. 16/291,172, filed Mar. 4, 2019, issued as U.S. Pat. No. 10,849,419, which claims the benefit of U.S. Provisional Application No. 62/640,359, filed Mar. 8, 2018, which are all hereby incorporated by reference herein in their entireties.

FIELD

This disclosure relates to oral care devices and, more specifically, to brushing devices for oral hygiene.

BACKGROUND

Oral care devices are known. One type of oral care device is disclosed in U.S. Pat. No. 8,529,150, which issued on Sep. 10, 2013, and which is hereby incorporated by reference in its entirety. One of the oral care devices disclosed in the '150 patent includes bristles surrounding a mouthpiece. A user may draw mouthwash from a reservoir within the oral care device via the mouthpiece.

DETAILED DESCRIPTION

An oral care device is provided that includes a body, a base connected to the body, and a mouthpiece extending from the base. The oral care device further includes an oral care product reservoir in communication with the mouthpiece and a plurality of brushing walls extending outwardly from the base about the mouthpiece. The brushing walls provide brushing action while at the same time providing space for the user to withdraw oral care product from the reservoir via the mouthpiece.

In one form, the brushing walls extend from the base varying distances and have free ends in a saddle-shaped arrangement about the mouthpiece. The saddle-shaped arrangement conforms to the mouth of a user and permits a user to readily withdraw oral care product from the reservoir via the mouthpiece.

In one form, the mouthpiece extends from the base a first distance and the brushing walls include inner brushing walls at the mouthpiece that extend from the base a second distance that is less than the first distance. Because the inner brushing walls are shorter than the mouthpiece, a free end of the mouthpiece can be disposed above free ends of the inner brushing walls. The oral care device may include toothpaste closing the mouthpiece. The taller mouthpiece keeps the toothpaste away from the free ends of the inner brushing walls which makes it easier to apply toothpaste to the mouthpiece during manufacture of the toothbrush as well as limits the risk of the inner brushing walls dislodging the toothpaste from the mouthpiece during transit.

In one form, the mouthpiece extends from the base a first distance and the brushing walls include outer brushing walls spaced from the mouthpiece that extend from the base a second distance that is greater than the first distance. These taller outer brushing walls are spaced from the mouthpiece so that the outer brushing walls may not interfere with toothpaste applied to close the mouthpiece. Further, the taller outer brushing walls can provide a brushing action without the mouthpiece interfering with the brushing action.

In another form, the base, mouthpiece, and brushing walls have a unitary, one-piece construction. This construction permits the brushing walls to be connected to the base without having to individually connect bristles to a base as in some prior toothbrush designs. Further, this provides a durable connection between the brushing walls and the base.

Figure 1:
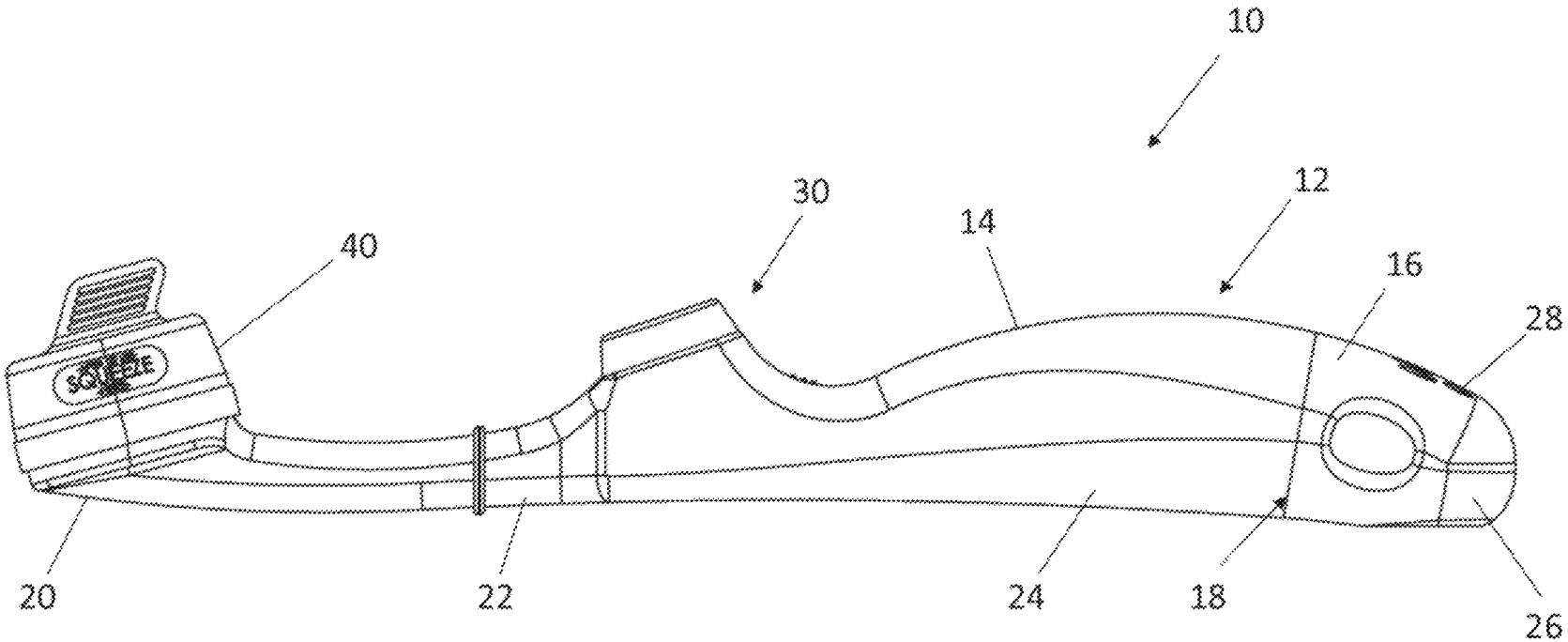
FIG. 1 is a side elevational view of a toothbrush having a handle and a removable cap covering a brush of the toothbrush.

With reference to FIG. 1, an oral care device, such as a toothbrush 10, is provided that includes a body 12 including a first body portion 14 and a second body portion 16 that are joined together by, for example, one or more ultrasonic welds 18. The first body portion 14 may include a head 20, a neck 22, and a handle 24. The first body portion 14 may have a unitary, one-piece construction and may be manufactured by, for example, blow molding plastic material. The second body portion 16 may include an endcap 26 having openings 28 therein. The endcap 26 may be manufactured by blow molding or by injection molding a plastic material.

Figure 11:
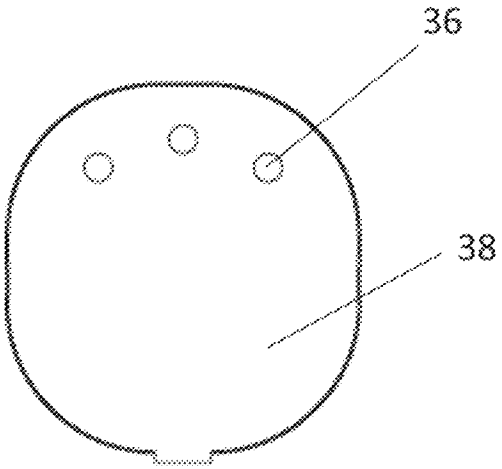
FIG. 11 is a plan view of a baffle that is received in the internal compartment of the toothbrush of FIG. 3.

The body 12 includes an inlet, such as a one-way input port 30, which permits the user to spit or discharge oral care byproducts after using the toothbrush 10 to brush the user's teeth through the input port 30 and into a compartment 32 (see FIG. 3) that contains absorbent material, such as cotton 34. When the user discharges the oral care byproduct into the compartment 32, the air associated with the byproduct can travel generally in direction 34 into the compartment 32, through openings 36 (see FIG. 11) of a baffle 38, and out from the openings 28. The cotton 34 absorbs the oral care byproduct and retains the oral care byproduct within the body 12.

The cotton 34 absorbs the oral care byproduct and the one-way input port 30 resists egress of the oral care byproduct from the compartment 32. This keeps the oral care byproduct in the compartment 32 and allows the user to dispose of the toothbrush 10 when it is convenient. For example, a user can brush her teeth with the toothbrush 10 while in a vehicle (such as an airplane), spit toothbrushing byproduct into the compartment 32 via the input port 30, and keep the toothbrush 10 until the toothbrush 10 can be disposed of properly.

Figure 3:
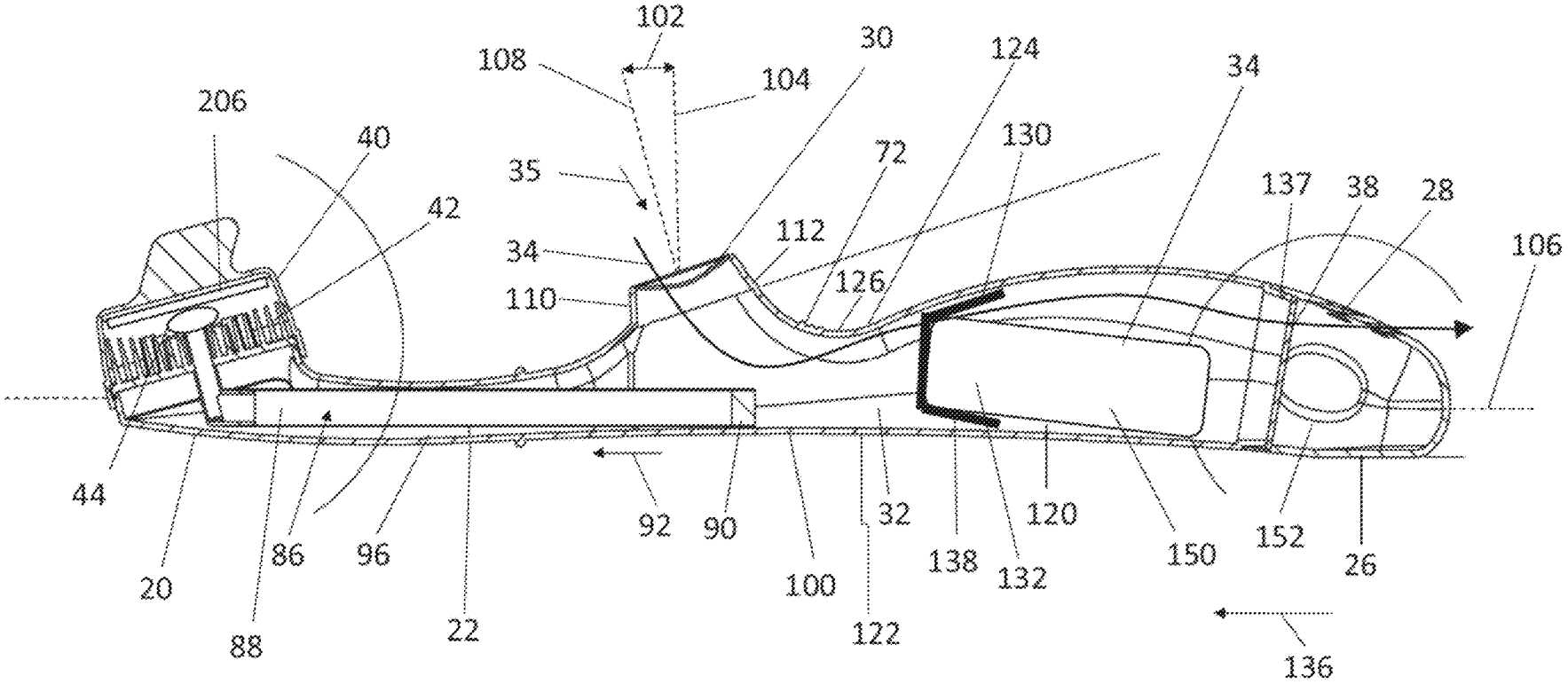
FIG. 3 is a cross-sectional view taken across line 3-3 in FIG. 2 showing an internal compartment of the toothbrush that contains a reservoir and absorbent material.

With reference to FIGS. 1 and 3, the toothbrush 10 includes a cap 40 connected to the head 20 for covering a brush 42 of the toothbrush 10. The toothbrush 10 may include toothpaste 44 on the brush 42 and the cap 40 protects the toothpaste 44. In another form, the brush 42 has toothpaste 44 thereon and the cap 40 has its own toothpaste 206 that may be applied to the brush 42 by squeezing the cap 40 against the brush 42. This allows users to have multiple uses of the toothbrush 10, i.e., the toothpaste 44 on the brush 42 is used for a first brushing operation and toothpaste 206 of the cap 40 is used for a second brushing operation. The compartment 32 and cotton 34 may be sized to accommodate the oral care byproducts from the two brushing operation. Further, the one-way input port 30 resists egress of oral care byproduct from the compartment 30 so that the user can carry the toothbrush 10 between the brushing operations and without the oral care byproduct spilling out from the toothbrush 10.

Figure 2:
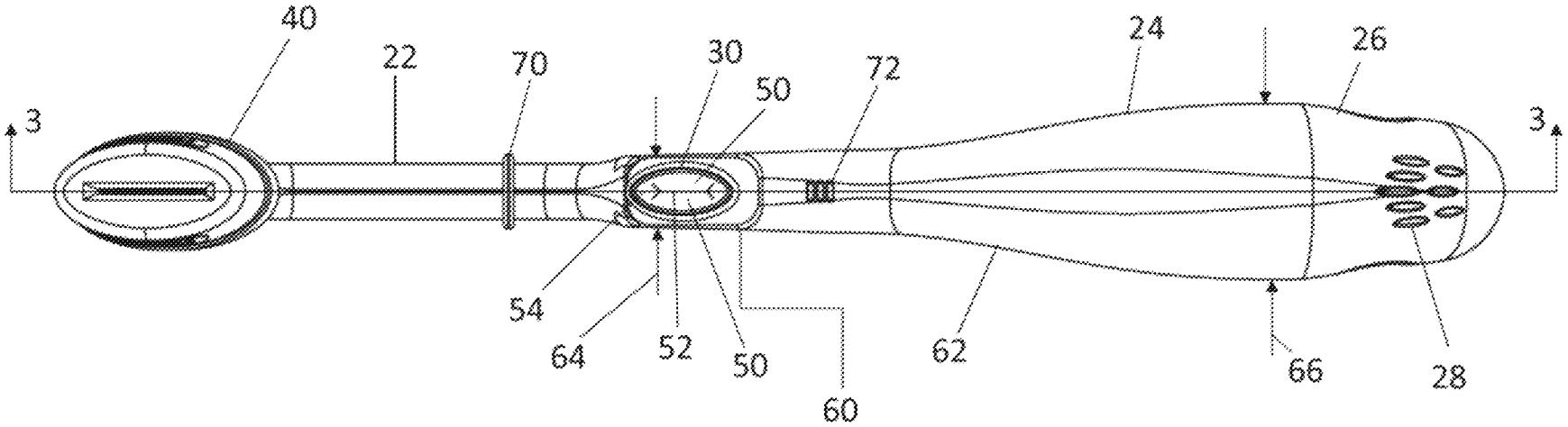
FIG. 2 is a top plan view of the toothbrush of FIG. 1 showing an input port intermediate the handle and the brush.

With reference to FIG. 2, the input port 30 includes one or more flaps 50 having an opening, such as a slit 52, separating the flaps 50. When a user spits or discharges oral care byproduct into the input port 30, the pressure from the action of discharging the oral care byproduct causes the flaps 50 to shift apart and permit the oral care byproduct to travel into the compartment 32. Once the user has stopped discharging oral care byproduct, the flaps 50 may return together to their initial configuration of FIG. 2. With the flaps 50 in their initial configuration, the flaps 50 may resist egress of the oral care byproduct through the input port 30. The flaps 50 also form a concave surface 54 that operates as a cup to receive the discharged oral care byproduct and directs the oral care byproduct into the input port 30.

The body 12 has a tapered profile that is wider at the handle 24 than at an input port portion 60 of the body 12. The body 12 has a tapered portion 62 that flares outwardly so that the input port portion 60 has a width 64 that is narrower than a width 66 of the handle 24. Because the handle 24 is wider at the width 66, the shape of the body 12 helps to encourage movement of the discharged oral care byproduct into the handle 24 and away from the input port portion 60. This is advantageous because the cotton 34 is within the handle 24 which helps absorb the oral care byproduct.

With reference to FIG. 2, the neck 22 includes a protrusion, such as an annular bead 70, which resists the movement of byproducts from a brushing operation along the neck 22 toward the handle 24. In other words, the annular bead 70 keeps brushing byproducts from getting onto the user's hand on the handle 24. The handle 24 may include one or more protrusions 72 for gripping during the brushing operation.

Figure 4:
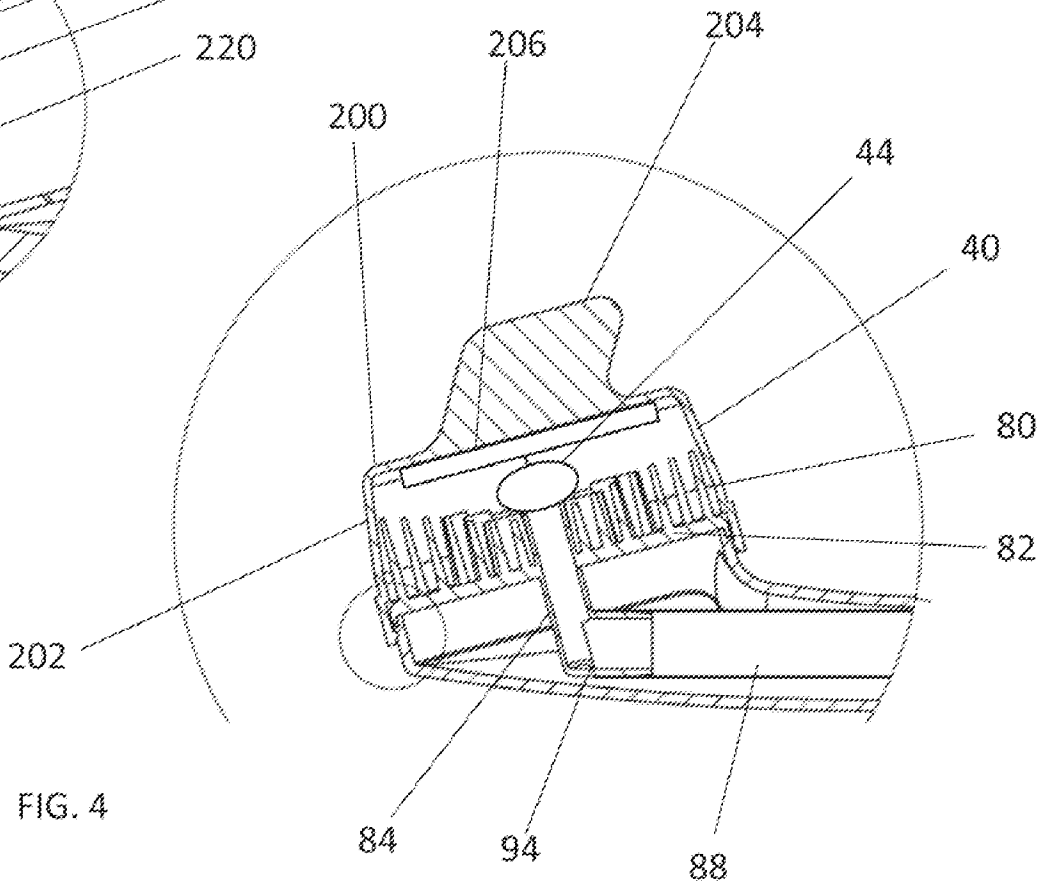
FIG. 4 is an enlarged portion of FIG. 3 showing the cap covering the brush of the toothbrush.

With reference to FIGS. 3 and 4, the brush 42 includes brushing walls 80 that are connected to a base 82 and a mouthpiece such as mouthpiece tube 84. The toothbrush 10 includes a reservoir 86 that contains an oral care product, such as mouthwash. The reservoir 86 includes a tube 88 that contains the mouthwash and a piston 90. When a user applies suction to the mouthpiece tube 84, the suction draws the mouthwash out of the reservoir 86 and the piston 90 travels in direction 92 along the tube 88 towards the mouthpiece tube 84. In this manner, the user can withdraw as much or as little mouthwash from the reservoir 86 as she wants. Once the user has withdrawn the desired amount of mouthwash, the user stops applying suction to the mouthpiece tube 84 and the piston 90 stops its travel in direction 92. The mouthpiece tube 84 may include an elbow 94 connecting the mouthpiece tube 84 to the reservoir tube 88. The elbow 94 orients the reservoir tube 88 to extend through a neck portion 96 of the compartment 32 and into an input port portion 100 of the compartment 32. The elbow 94 also operates as a stop to inhibit the piston 90 from entering the mouthpiece tube 84. In one form, the brushing walls 80, base 82, and mouthpiece tube 84 have a unitary, one-piece construction. This allows the brushing walls 80, base 82 and mouthpiece tube 84 to be made from a single piece of material, such as by injection molding or 3D printing. This is an advantage over some prior approaches where individual bristles had to be connected to a support plate. The elbow 94 may also have a unitary, one-piece construction with the brushing walls 80, base 82, and mouthpiece tube 84.

With continued reference to FIG. 3, the input port 30 has an axis 108 extending therethrough that is oriented at an angle 102 from an axis 104 that extends perpendicular to a longitudinal axis 106 of the toothbrush 10. The input port 30 has walls 110, 112 extending downwardly on either side thereof and that are generally oriented to extend along the axis 108. Because the input port 30 is oriented at the angle 102, this positions the input port 30 so that it is out of the way of the hand of the user holding the handle 24. The user can then thereby discharge oral care byproduct into the input port 30 away from her fingers and away from her cheek.

With reference to FIG. 3, the compartment 32 includes a handle portion 120 that contains the cotton 34. The body 12 includes walls 122, 124 across the compartment 32 from each other and a curved wall 126 connecting the wall 112 to the wall 124. The curved wall 126 directs the discharged oral care byproducts traveling into the compartment 32 in direction 35 toward the wall 122. The oral care byproducts travel through the handle 24 toward the openings 36 of the baffle 38 and are absorbed by the cotton 34.

The toothbrush 10 includes a harness 130 that elevates a leading end portion 132 of the cotton 34 away from the walls 122, 124. Separating the cotton leading end portion 132 from the walls 122, 124, limits damming that could occur if the oral care byproducts are immediately absorbed by the cotton leading end portion 132 upon being discharged into the input port 30. In other words, the oral care byproducts can first go around the leading end portion 132 and be absorbed by the trailing end portion 150 without the leading end portion 132 swelling up and resisting oral care byproducts from reaching the trailing end portion 150.

Figure 12:
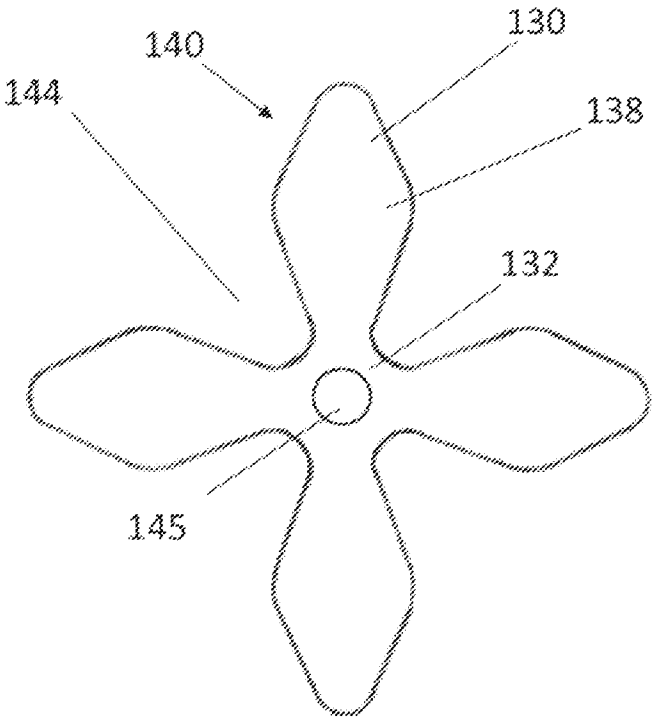
FIG. 12 is a plan view of a harness that supports the absorbent material in the toothbrush compartment of FIG. 3.

In one approach, the harness 130 is cut, stamped, or otherwise formed from a flat piece of material such as plastic as shown in FIG. 12. During manufacture of the toothbrush 10, the harness 130 is positioned so that its center 132 thereof contacts the cotton leading end portion 132. The harness 130 and cotton 34 are advanced in direction 136 (see FIG. 3) through an opening 137 of the first body portion 14 during assembly. This bends arms 138 of the harness 30 around the cotton leading end portion 132 as the harness 130 and cotton 34 are advanced in direction 136 into the first body portion 14. The arms 138 contact the walls 122, 124 and elevate the cotton leading end portion 132 away therefrom. The arms 138 include end portions 140 that contact the walls 122, 124 and elevate the cotton leading end portion 132. The harness 130 includes gaps 144 between the arms 138 that allow oral care byproducts to travel around the harness 130 into contact with the cotton 34. Particularly, the oral care byproducts will travel around the cotton leading end portion 132 and reach the trailing end portion 150 of the cotton 34. Regarding FIG. 12, the cotton leading end portion 132 may include a through opening 145. Before the cotton 34 and harness have been advanced into the first body portion 14, an elongate instrument such as a rod may be advanced through the cotton 34 and the through opening 145. The rod is used to keep the harness 130 centered on the cotton 34 and keeps the cotton 34 and harness 130 together as they are advanced into the first body portion 14.

Once the cotton 34 and harness 130 have been advanced into the first body portion 14, the manufacturer positions the baffle 38 to cover the opening 137 and connects the end cap 26 to the first body portion 14 such as by ultrasonic welding. This captures the cotton 34, harness 130, and baffle 38 in the compartment 32. The end cap 26 includes a cavity 152. The baffle 38 (see FIG. 11) resists movement of the oral care byproduct in the compartment 32 into the cavity 152 of the end cap 26 while permitting air associated with the oral care byproduct to travel into the cavity 152 and out from the toothbrush via the openings 28. In one form, the baffle 38 (see FIG. 11) may have openings 36 or one-way valve(s) that only open in response to air pressure when the user is discharging oral care byproducts into the input port 30.

With reference to FIG. 4, the cap 40 includes a wall 200 and a skirt 202 depending from the wall 200. The cap 40 has a tab 204 extending upward from the wall 200. The tab 204 is sized to be grasped by a user and permit the user to remove the cap 40 from the head 20. The cap 40 may be made from a relatively soft material, such as low-density polyethylene (LDPE) that permits a user to squeeze the skirt 202 between the user's index and thumb to squeeze toothpaste 206 on the wall 200 against free ends of the brushing walls 80.

Figure 5:
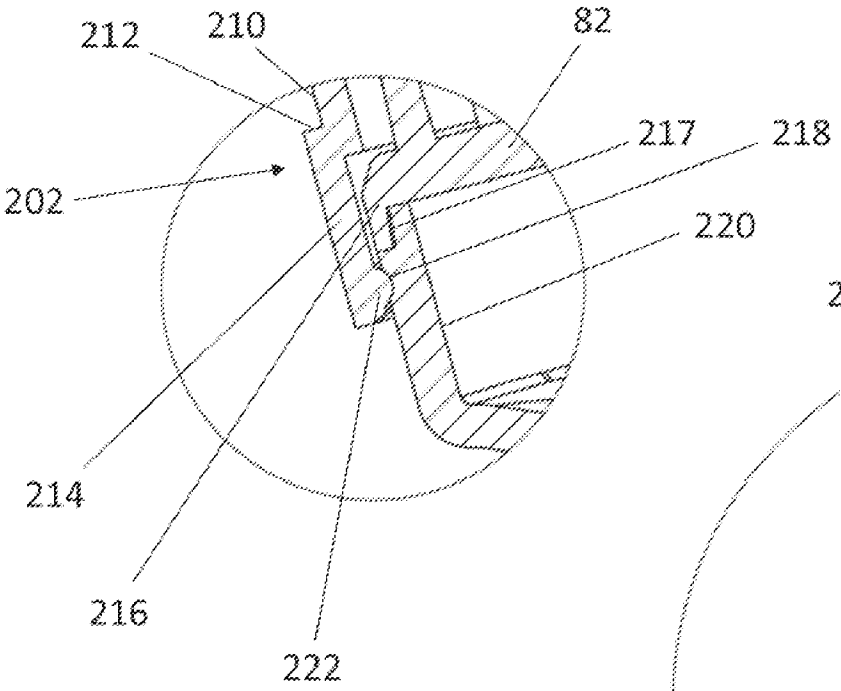
FIG. 5 is an enlarged portion of FIG. 4 showing an interface between the cap and a head of the toothbrush.

With reference to FIG. 5, the cap skirt 202 includes a skirt upper portion 210, a shoulder 212, and a skirt lower portion 214. The shoulder 212 flares outward toward the skirt lower portion 214 to permit the skirt lower portion 214 to fit over and around a skirt 216 of the base 82. The base skirt 216 fits into a groove 217 of a wall 220 of the head 20. The base 82 may be secured to the head wall 220 by, for example, ultrasonic welding. The head wall 220 has a groove 218 and the skirt 202 includes a protrusion, such as a bead 222, which engages the groove 218 and releasably connects the cap 40 to the head 20.

Figure 6:
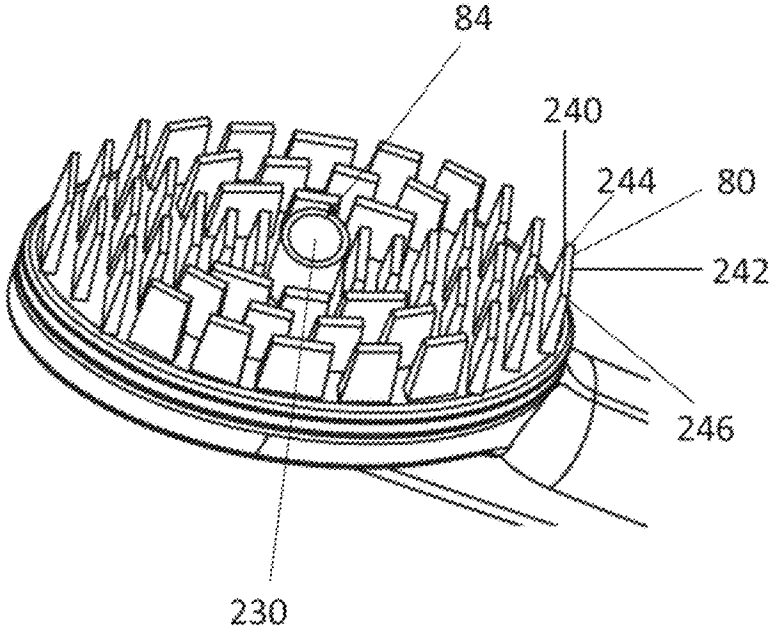
FIG. 6 is a perspective view of the brush of the toothbrush of FIG. 1 showing brushing walls and a mouthpiece of the toothbrush.

With reference to FIG. 6, the mouthpiece tube 84 includes an opening 230 that may be closed by the toothpaste 44. The presence of the toothpaste 44 at the mouthpiece tube opening 230 and the piston 90 at the end of the reservoir tube 88 keep the mouthwash within the reservoir 86.

Figure 7:
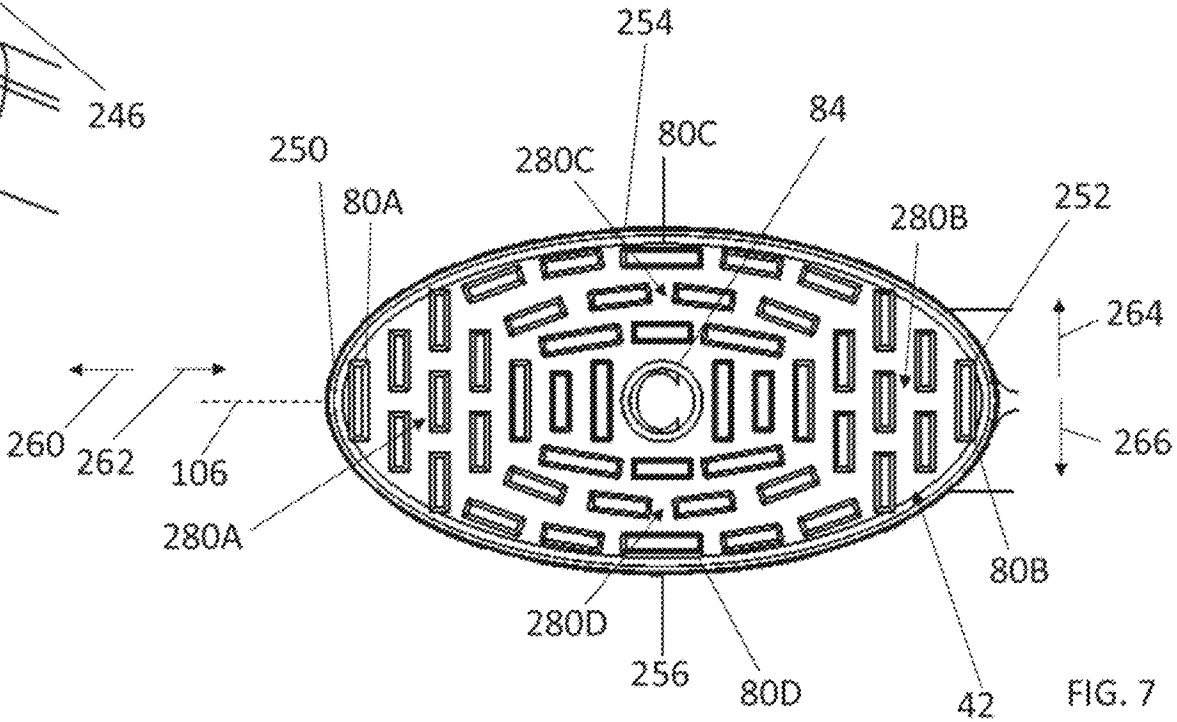
FIG. 7 is a top plan view of the brush of FIG. 6 showing the brushing walls having varying orientations about the mouthpiece.

With reference to FIGS. 6 and 7, the brushing walls 80 have a chisel or wedge-shape and include a pair of primary edges 240, 242. The brushing walls 80 have secondary edges 244, 246 extending between the primary edges 240, 242.

With reference to FIG. 7, the brush 42 includes longitudinal end portions 250, 252 and lateral side portions 254, 256. The brushing walls 80 include a first plurality of brushing walls 280A having elongate primary edges thereof oriented in a first pattern and a third plurality of brushing walls 280B having elongate primary edges thereof oriented in a third pattern. The first plurality of brushing walls 280A and the third plurality of brushing walls 280B are aligned in a longitudinal direction 260 with the mouthpiece and on opposite sides of the mouthpiece. The brushing walls 80 also include a second plurality of brushing walls 280C having elongate primary edges thereof oriented in a second pattern and a fourth plurality of brushing walls 280D having elongate primary edges thereof oriented in a fourth pattern. The second plurality of brushing walls 280C and the fourth plurality of brushing walls 280D aligned in a lateral direction 264 with the mouthpiece and on opposite sides of the mouthpiece. The brushing walls 80 include end brushing walls 80A, 80B oriented so that the primary edges 240, 242 thereof extend transverse to the longitudinal axis 106 of the toothbrush 10. End brushing wall 80A may be one of the first plurality of brushing walls 280A and end brushing wall 80B may be one of the third plurality of brushing walls 280B. The brushing walls 80 further include side brushing walls 80C, 80D having their primary edges 240, 242 extending along the longitudinal axis 106. End brushing wall 80C may be one of the second plurality of brushing walls 280C and end brushing wall 80D may be one of the fourth plurality of brushing walls 280D. In this manner, the end brushing walls 80A, 80B can remove debris when the user moves the brush 42 generally in axial directions 260, 262 and the side brushing walls 80C, 80D can remove debris when moved in directions 264, 266. In one embodiment, the brushing walls 80 each have a height and a non-circular cross section taken perpendicular to the height (see, e.g., FIG. 6).

Figure 8:
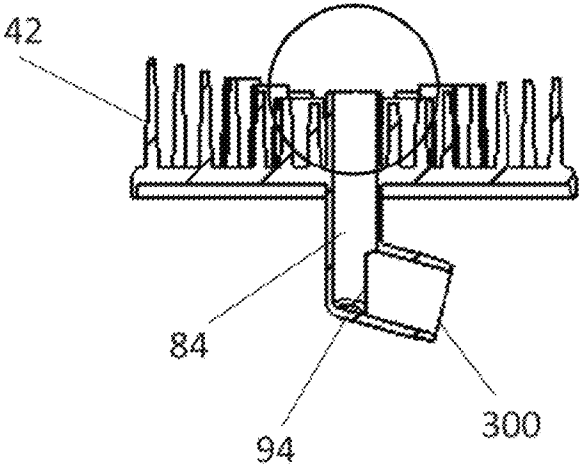
FIG. 8 is a cross-sectional view of the brush of FIG. 7.

With reference to FIG. 8, the elbow 94 includes a socket portion 300 for receiving the reservoir tube 88.

Figure 9:
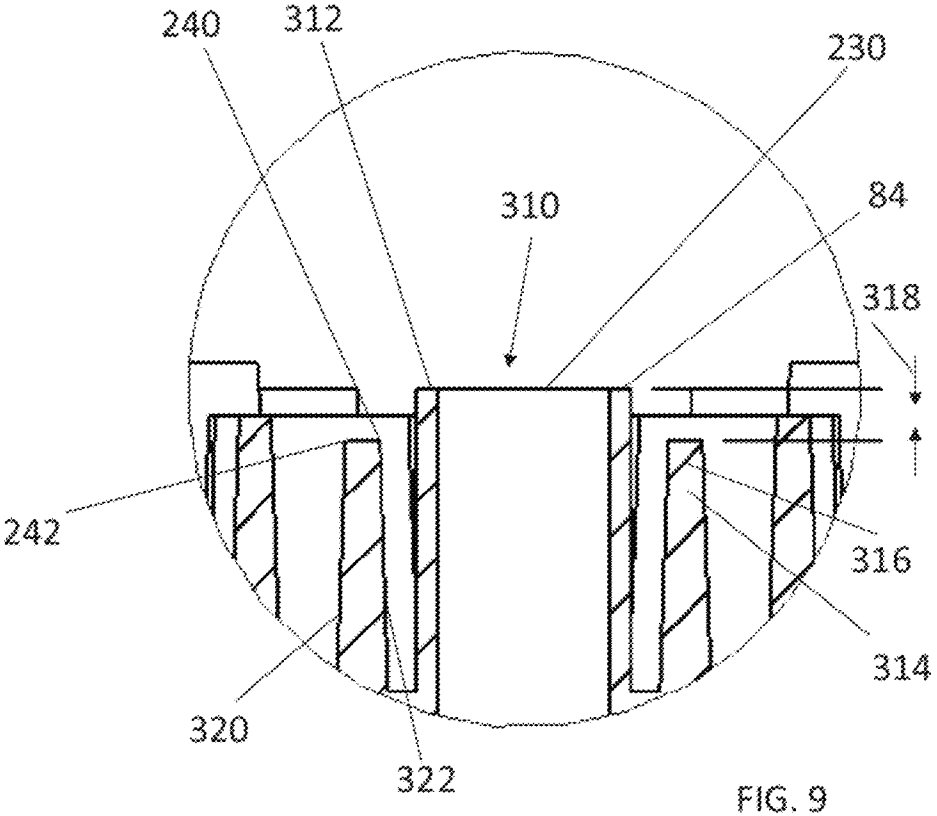
FIG. 9 is an enlarged view of a portion of the brush of FIG. 8 showing the mouthpiece extending upward beyond nearby brushing walls.

With reference to FIG. 9, the mouthpiece tube 84 includes an upper free end 310 having a rim 312. The brushing walls 80 include brushing walls 314 at the tube 84. The brushing walls 314 include free ends 316 that are a distance 318 below the rim 312 of the reservoir tube 84 so that the rim 312 is higher or proud of the free ends 316. The clearance between the rim 312 and the brushing wall free ends 316 reduces the interference the free ends 316 of the brushing walls 314 cause when a user forms a seal with the user's lips around the tube 84. Further, the clearance between the rim 312 and the brushing wall free ends 316 spaces the free ends 316 from toothpaste positioned on the rim 312 to close the opening 230. This reduces the risk of the free ends 316 jarring or otherwise loosening the toothpaste from the rim 312. As also shown in FIG. 9, the brushing walls 80 have a wedge-shaped cross section including surfaces 320, 322 that taper outwardly away from one another as the surfaces 320, 322 extend downward from the primary edges 240, 242.

Figure 10:
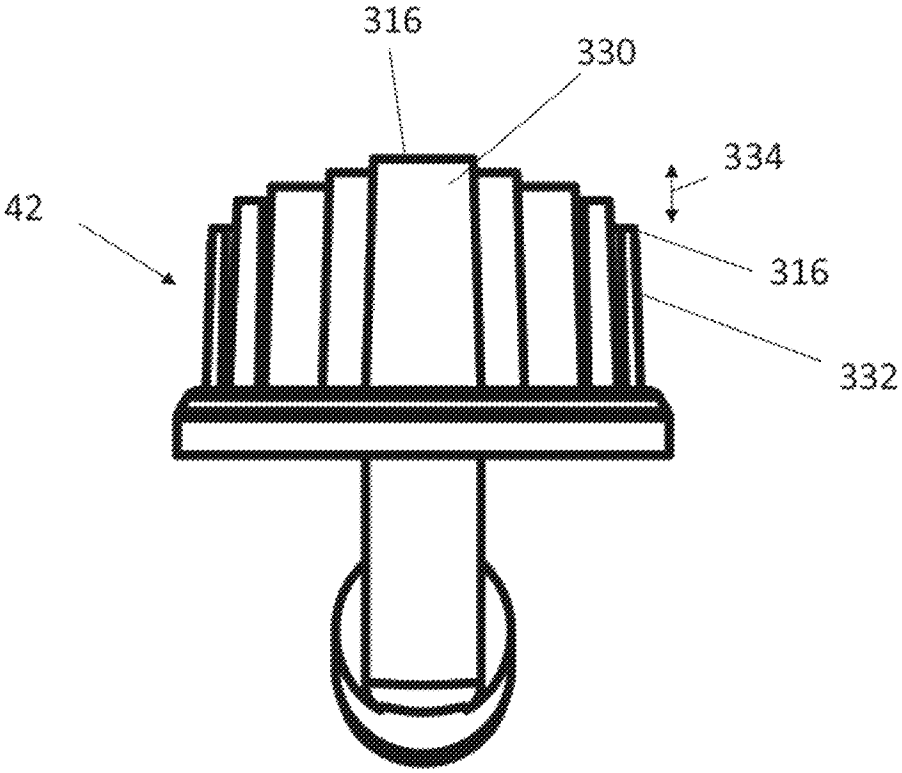
FIG. 10 is an end elevational view of the brush of FIG. 8 showing a brushing wall at the middle of the brush being taller than brushing walls at lateral sides of the brush.

With reference to FIGS. 8 and 10, the brushing walls 80 form a saddle-shape by way of the varying heights of the brushing walls 80. The saddle-shape is formed by the free ends 316 of the brushing walls 80. As shown in FIG. 8, the brushing walls 80 have a decreasing height as the brushing walls 80 get closer to the mouthpiece tube 84 along the axis 106. With reference to FIG. 10, the brushing walls 80 also vary in height in a lateral direction across the brush 42. The brushing walls 80 include longitudinal end walls 330 and a lateral side wall 332. The free end 316 of the brushing wall 332 has a height that is a distance 334 shorter than a height of the end wall 330. The saddle-shaped arrangement of the brushing wall free ends 316 provides a profile of the free ends 316 that compliments the shape of a user's mouth and makes it more comfortable for the user to apply suction to the mouthpiece tube 84.

While there have been illustrated and described particular embodiments of the present invention, it will be appreciated that numerous changes and modifications will occur to those skilled in the art, and it is intended for the present invention to cover all those changes and modifications which fall within the scope of the appended claims.

What is claimed is:

1. An oral care device comprising:

a handle;

a head connected to the handle;

a base of the head;

a plurality of brushing walls of the head extending from the base, the brushing walls having free ends with elongate primary edges;

the base and the brushing walls having a unitary, one-piece construction;

the brushing walls including a first plurality of brushing walls having the elongate primary edges thereof oriented in a first pattern; and the brushing walls including a second plurality of brushing walls having the elongate primary edges thereof oriented in a second pattern different than the first pattern.

2. The oral care device of claim 1 wherein the brushing walls include a third plurality of brushing walls spaced from the first plurality of brushing walls, the third plurality of brushing walls having the elongate primary edges thereof oriented in a third pattern symmetric to the first pattern.

3. The oral care device of claim 2 wherein the brushing walls include a fourth plurality of brushing walls spaced from the second plurality of brushing walls, the fourth plurality of brushing walls having the elongate primary edges thereof oriented in a fourth pattern symmetric to the second pattern.

4. The oral care device of claim 1 wherein the oral care device includes a longitudinal axis;

wherein the second pattern of the second plurality of brushing walls includes the elongate primary edges thereof having an arcuate orientation along the longitudinal axis.

5. The oral care device of claim 4 wherein the first pattern of the first plurality of brushing walls includes the elongate primary edges thereof oriented transverse to the longitudinal axis.

6. The oral care device of claim 1 wherein the brushing walls each have a chisel shape.

7. The oral care device of claim 1 wherein the brushing walls each have a height and a non-circular cross section taken perpendicular to the height.

8. The oral care device of claim 1 wherein the base of the head is elliptical.

9. The oral care device of claim 1 wherein the oral care device has a longitudinal axis; and wherein the first plurality of brushing walls are disposed along the longitudinal axis and the second plurality of brushing walls are laterally offset from the longitudinal axis.

10. The oral care device of claim 1 wherein the head and handle have a unitary, one-piece construction.

11. The oral care device of claim 10 wherein the base is assembled with the head.

12. An oral care device comprising:

a body;

a base connected to the body;

an oral care product reservoir having an open end and a closed end opposite the open end;

a mouthpiece extending from the base and in communication with the open end of the oral care product reservoir;

a plurality of brushing walls extending from the base about the mouthpiece; and wherein the brushing walls, the base, and the mouthpiece have a unitary, one-piece construction.

13. The oral care device of claim 12 wherein the brushing walls each have a height and a non-circular cross-section perpendicular to the height.

14. The oral care device of claim 12 wherein the mouthpiece extends from the base a first distance; and wherein the brushing walls include a first plurality of brushing walls spaced from the mouthpiece and extending from the base a second distance that is greater than the first distance so that the first plurality of brushing walls are proud of the mouthpiece.

15. The oral care device of claim 14 wherein the brushing walls include a second plurality of brushing walls adjacent the mouthpiece, the second plurality of brushing walls extending from the base a third distance that is less than the first distance so that the mouthpiece is proud of the second plurality of brushing walls.

16. The oral care device of claim 12 wherein the brushing walls include:

first and second brushing walls aligned in a first direction with the mouthpiece and on opposite sides of the mouthpiece; and wherein the first and second brushing walls have primary edges extending in a second direction perpendicular to the first direction.

17. The oral care device of claim 16 wherein the brushing walls further include:

third and fourth walls aligned in the second direction with the mouthpiece and on opposite sides of the mouthpiece; and wherein the third and fourth brushing walls have primary edges extending in the first direction.

18. The oral care device of claim 12 wherein the brushing walls are chisel-shaped.

19. The oral care device of claim 12 wherein the brushing walls have varying heights about the base and include free ends forming a saddle-shaped profile.

20. The oral care device of claim 12 wherein the brushing walls include free ends opposite the base, each free end including a pair of primary edges and a pair of secondary edges, the secondary edges being shorter than the primary edges.

21. The oral care device of claim 12 wherein the brushing walls each include a free end and side edges extending intermediate the base and the free end.

22. The oral care device of claim 12 wherein the oral care product reservoir is elongated and is oriented to extend away from the base in the body.

23. The oral care device of claim 12 wherein the oral care product reservoir comprises a tube; and wherein the closed end of the elongate oral care product reservoir comprises a piston in the tube.

24. The oral care device of claim 12 wherein the mouthpiece comprises a tube having a first portion extending from the base on an outer side of the base adjacent the brushing walls and a second portion extending from the base on an inner side of the base opposite the first portion and the brushing walls; and wherein the oral care product reservoir is secured to the second portion of the mouthpiece tube.

25. The oral care device of claim 12 wherein the body includes a head and a handle.

26. An oral care device comprising:

a body;

a base connected to the body;

an oral care product reservoir;

a mouthpiece extending from the base and in communication with the oral care product reservoir;

a plurality of brushing walls extending from the base about the mouthpiece;

wherein the brushing walls, the base, and the mouthpiece have a unitary, one-piece construction; and toothpaste covering an opening of the mouthpiece.

* * * * *